US005766349A

United States Patent [19]

Soyama et al.

[11] Patent Number: 5,766,349

[45] Date of Patent: Jun. 16, 1998

[54] TRANSFER APPARATUS FOR TRANSFERRING BONDING AGENT

[75] Inventors: Mitsuyoshi Soyama; Masahiro Kanai; Masaru Kamisawa; Wataru Takahashi; Takayoshi Mizuno, all of Nagano, Japan

[73] Assignee: Seiko Epson Corporation, Tokyo, Japan

[21] Appl. No.: 617,943

[22] Filed: Mar. 15, 1996

[30] Foreign Application Priority Data

Mar. 15, 1995 [JP] Japan ..... 7-083333
Feb. 29, 1996 [JP] Japan ..... 8-069009

[51] Int. Cl.[6] ..... B05C 11/02

[52] U.S. Cl. ..... 118/120; 118/66; 118/213; 118/244; 118/258; 118/406; 156/578; 156/230; 156/235; 156/247; 156/249; 156/344

[58] Field of Search ..... 118/66, 120, 213, 118/244, 258, 406; 156/230, 235, 247, 249, 344, 578

[56] References Cited

U.S. PATENT DOCUMENTS

| | | | |
|---|---|---|---|
| 2,755,196 | 4/1956 | Scholl | 118/213 |
| 3,919,973 | 11/1975 | Zimmer | 118/406 |
| 4,224,870 | 9/1980 | Mikulas | 118/213 |
| 4,379,185 | 4/1983 | Smith et al. | 118/406 |
| 4,556,446 | 12/1985 | Yudenfriend | 156/551 |
| 4,578,288 | 3/1986 | Lare et al. | 427/365 |
| 4,802,945 | 2/1989 | Opina | 156/249 |
| 4,978,402 | 12/1990 | Hallworth | 118/406 |
| 5,022,948 | 6/1991 | Hallworth | 118/258 |
| 5,395,643 | 3/1995 | Brown et al. | 118/213 |

FOREIGN PATENT DOCUMENTS

| | | | |
|---|---|---|---|
| 0538869 | 4/1993 | European Pat. Off. | B05C 1/08 |
| 57-91274 | 6/1982 | Japan | B41J 3/04 |
| 4-150974 | 5/1992 | Japan | B05D 5/10 |
| 5-263 | 1/1993 | Japan | 118/213 |

*Primary Examiner*—Donald E. Czaja
*Assistant Examiner*—Michael P. Colaianni
*Attorney, Agent, or Firm*—Sughrue, Mion, Zinn, Macpeak & Seas, PLLC

[57] ABSTRACT

An apparatus for transferring and spreading a high-viscosity bonding agent to a thickness of about 10 μm on a bonding-agent onto a member. The device includes a squeegee table on which a bonding agent is spread, and a film moving device for feeding a film made of elastic material from one end to the other end of the squeegee table at a predetermined speed and sticking the film onto the bonding agent. The film moving device then peels the film off the spreading side at a speed at which the upper half of the bonding agent layer is peeled off from the other end of the squeegee table, whereby the thickness of the bonding agent is reduced to half of that which has been spread on the squeegee table. The film moving device then feeds the film having the bonding agent onto a member and peels off the film from the member, thereby transferring a bonding agent having a thickness of about ¼ of the thickness of the bonding agent spread on the spreading side, not greater than 10 μm, for example, to the member.

6 Claims, 5 Drawing Sheets

TRANSFER APPARATUS FOR TRANSFERRING BONDING AGENT

BACKGROUND OF THE INVENTION

1. Technical Field of Industrial Application

The present invention relates to the technology of applying a high-viscosity bonding agent having a small thickness to a member.

2. Related Art

In the case of an ink-jet recording head, for example, which has a nozzle plate with a plurality of nozzle holes bored therein, a pressure generator, an ink supply port, a spacer for partitioning a common ink chamber and a second plate, which are fixedly formed in layers so that ink drops are made to jet out of the nozzle holes under the pressure generated in a pressure generating chamber by means of piezoelectric vibrators, piezoelectric vibrators whose tips are approximately tens to hundreds of μm in size and which are arranged at intervals of tens of μm must be fastened to a vibrating plate by means of a bonding agent.

In order to fasten such microscopic members disposed at small intervals to the vibrating plate with a bonding agent, the bonding agent, which is as viscous as possible in an unhardened state, needs to be applied uniformly without overcoating at the time of pressure-bonding.

For the reason stated above, a bonding agent is spread on a board with a squeegee or the like as thin as possible and subsequently the bonding agent thus spread on the board is transferred and spread onto and adhered as disclosed in Japanese Unexamined Patent Publications Nos. 91274/1982 and 150974/1992. However, the minimum possible thickness of such a bonding agent that can be spread by a squeegee or the like is in the order of tens of μm, which is far greater than that of an ideal bonding agent layer for use in the manufacture of ink-jet recording heads. Such a large thickness causes a decrease in the production yield which arises from overcoating and the like at the time of bonding.

SUMMARY OF THE INVENTION

An object of the present invention made in view of foregoing problems is to provide a method of transferring a bonding agent capable of transferring and spreading the bonding agent as thin as possible and uniformly.

Another object of the present invention is to provide an apparatus for materializing the aforesaid method.

In order to solve the foregoing problems, a method of transferring a bonding agent according to the present invention comprises the steps of, firstly, spreading the bonding agent in the form of a layer having a predetermined thickness on a bonding-agent spreading side; secondly, paying out a film made of elastic material from one end to the other end of the bonding-agent spreading side at a predetermined speed and sticking the film onto the bonding agent layer; thirdly, peeling the film off the spreading side at a speed at which the upper half of the bonding agent layer is peeled off from the other end of the spreading side; and fourthly, transferring the bonding agent layer spread on the film to an adhered.

A thin bonding agent layer is formed on the film by making the bonding agent manifest elastic properties out of the viscoelastic properties by means of fast peeling to divide the bonding agent layer into two. When the bonding agent on the film is transferred and adhered, half the thickness of the bonding agent layer on the film is transferred to the adherent.

DETAILED DESCRIPTION OF THE PREFERRED EMBODIMENT

Figure 1:
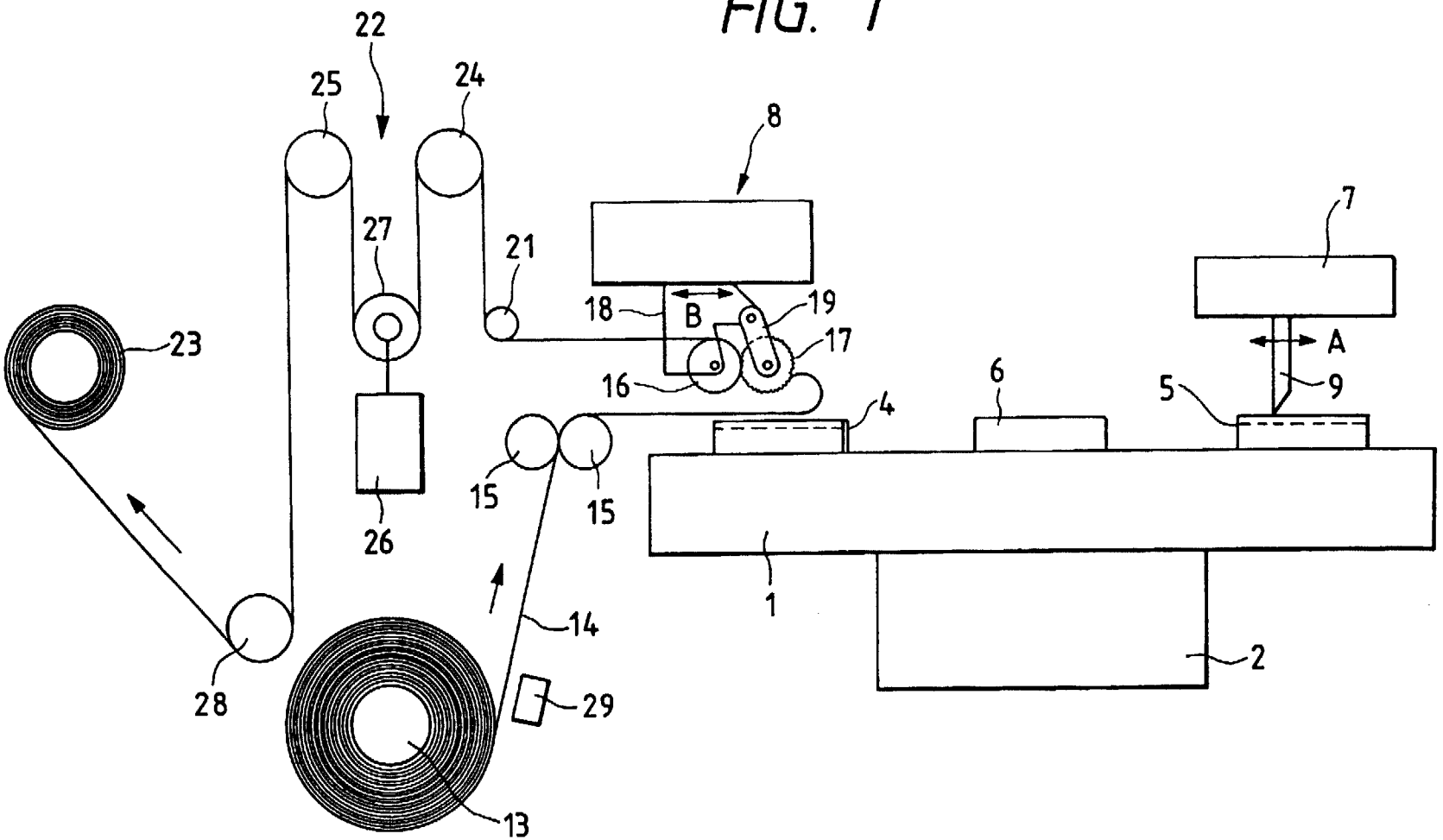
FIG. 1 is a block diagram illustrating an apparatus fit for a method of spreading a bonding agent embodying the present invention.
Figure 2:
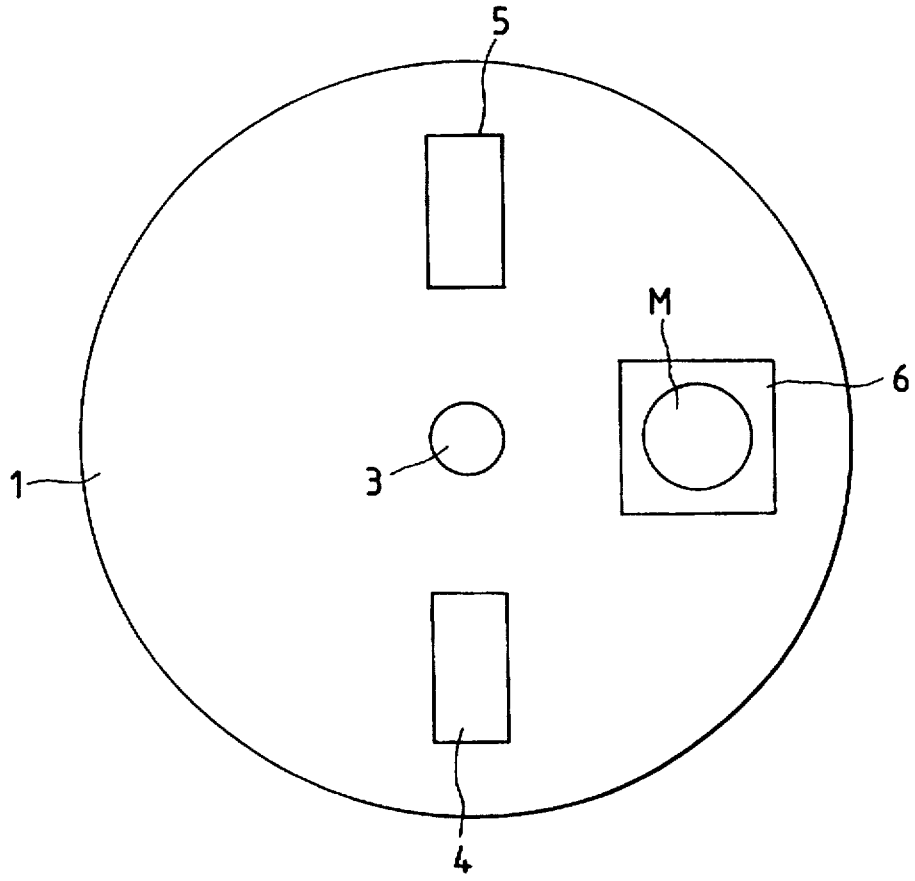
FIG. 2 is a diagram illustrating a rotary table embodying the present invention.

FIG. 1 shows a bonding-agent spreading apparatus embodying the present invention, wherein reference numeral 1 denotes a rotary table intermittently driven by a driving means 2. As shown in FIG. 2, two squeegee tables 4, 5 are symmetrically arranged about a rotary shaft 3, and an adhered mounting table 6 is placed in a position apart by 90 degrees from each of the squeegee tables 4, 5.

Figure 3:
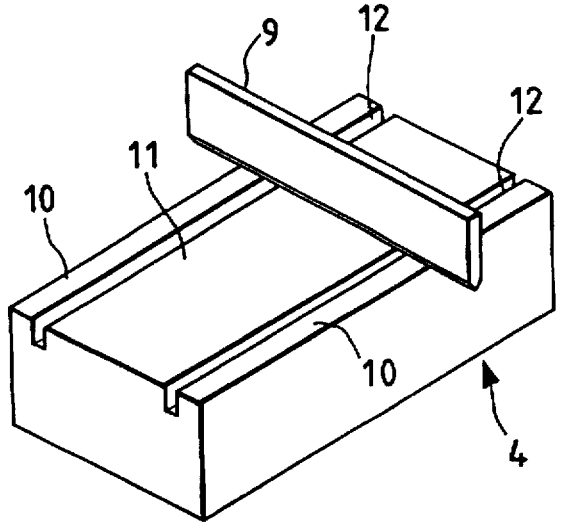
FIG. 3 is a diagram illustrating a squeegee table embodying the present invention.

Referring to FIG. 1 again, there is shown an arrangement of a squeegee unit 7 with the rotary shaft 3 as a point of symmetry, and a film moving unit 8 as will be described later. The squeegee unit 7 drives a blade 9 in the radial direction of the rotary table 1, and as shown in FIG. 3, each of the squeegee tables 4, 5 is provided with a squeegee guideway 10 on both sides. Further, a bonding-agent spreading side 11 positioned between the guideways 10 at a height approximately one film thickness, about 20 μm, below the height guideways 10 on which a bonding agent can be spread stably by the blade 9 is formed on the squeegee tables 4 and 5. Also, bonding-agent recovering grooves 12, 12 are formed between the guideways 10, 10 and the bonding-agent spreading side 11.

Figure 4:
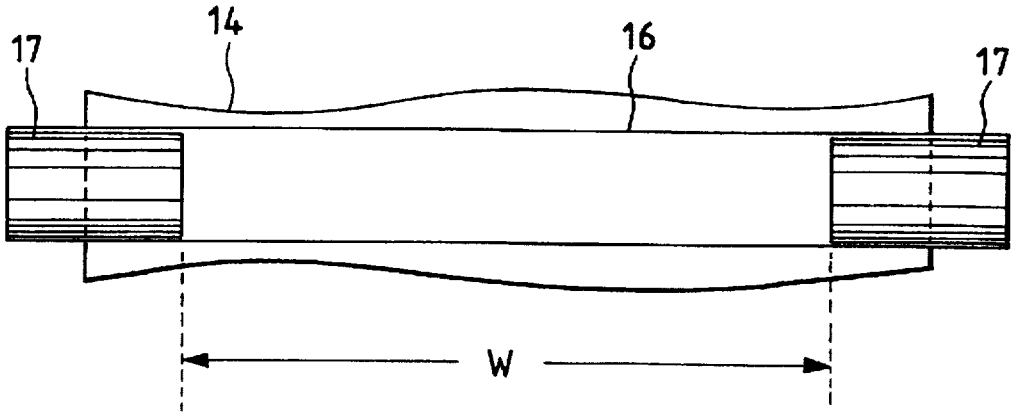
FIG. 4 is a diagram illustrating a roller of a film moving unit.

The film moving unit 8, which is reciprocally movable at a predetermined speed in the radial direction of the rotary table 1, is fitted with a back roller 16 for supporting the whole width W of the back side of a film 14 (as shown in FIG. 4) in such a state that the film 14 wound on a stock roller 13 is held by the guide rollers 15, 15 at a height substantially equal to that of the bonding-agent spreading sides 11 of the respective squeegee tables 4, 5. The film 14 is a macromolecular film. The film moving unit 8 is also fitted with retaining rollers 17 which partially hold both end sides of the surface of the film 14 and are so disposed as to provide a space at least greater than the width of the squeegee table 4. The back roller 16 and the retaining rollers 17 are rotatably fitted to a base 18.

The back roller 16 is coupled to a driving means (not shown) and can be used to wind up and pay out the film 14, whereas the retaining rollers 17, which are gear-shaped in cross section, are urged by arms 19 so as to resiliently contact the back roller 16.

After the downstream side of the film 14 is substantially horizontally retained by a guide roller 21, it is kept in tension by a tension applying means 22 and the used area of the film 14 is wound up by a winding roller 23.

The tension applying means 22 includes two guide rollers 24, 25 spaced apart as prescribed and kept at the same height, and a roller 27 provided between the guide rollers 24, 25 and coupled to an elasticity imparting mechanism 26. When the film 14 is stretched between the guide rollers 24, 25 via the roller 27, the tension set by the elasticity imparting mechanism 26 gives the film 14 constant tension. A fluoroplastic coating layer is formed on the surfaces of these rollers 24, 25, 27 so as to minimize the sticking of the bonding agent onto them. In FIG. 1, reference numeral 28 denotes a guide roller; and 29, a static eliminator for eliminating the electric charge of the film 14.

Figure 5A:
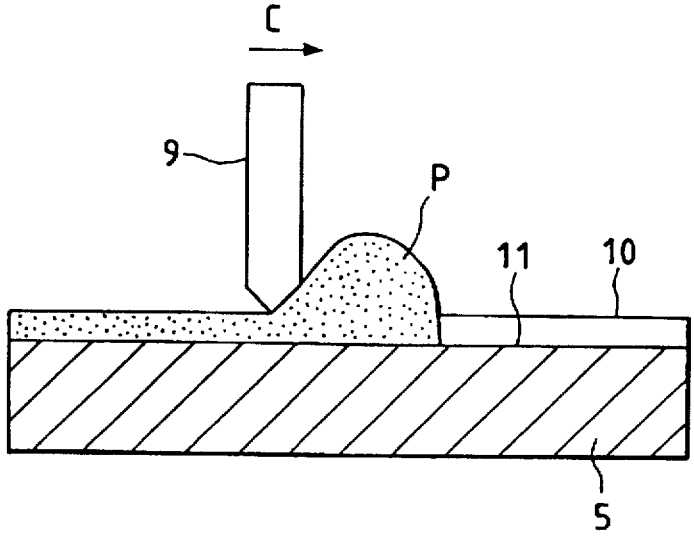
FIGS. 5A–5C are process diagrams each illustrating the steps of transferring a bonding agent to a film in the method of transferring the bonding agent according to the present invention.

With the apparatus thus arranged, the rotary table 1 is turned to move the squeegee table 5 on one side thereof below the squeegee unit 7 and a predetermined amount of one- or two-pack bonding agent p whose viscosity ranges from approximately 100 to 100,000 cps is supplied onto the bonding-agent spreading side 11 of the squeegee table 5. When the blade 9 is moved from one end to the other end at a predetermined speed (in the direction of an arrow C in FIG. 5A) while it is resiliently pressed against the guideways 10, 10, the bonding agent p having a predetermined thickness is spread because of the level difference between the guideways 10 and the spreading side. The surplus bonding agent p is recovered into the bonding-agent recovering grooves 12 during this process.

The rotary table 1 is turned at the stage where the spreading of the bonding agent is terminated and the squeegee table 5 with the bonding agent P thus spread is positioned under the film moving unit 8.

Figure 5B:
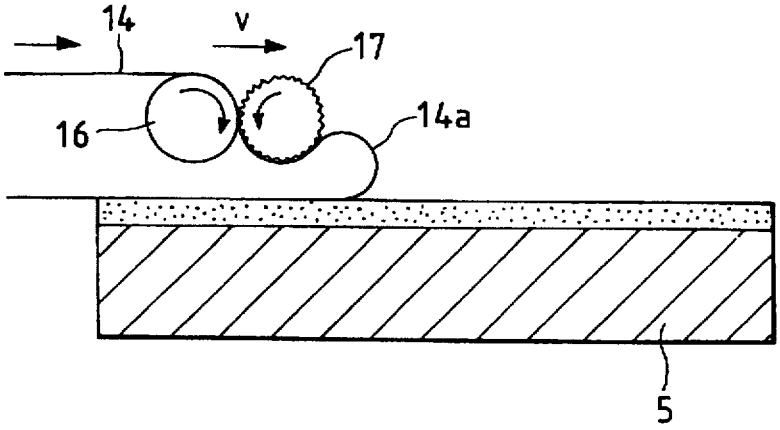

When a predetermined amount of film 14 is drawn out in that state, the film 14 is paid out onto the squeegee table 5 while being stripped of the charge by the static eliminator 29. At the stage where the predetermined amount of film 14 has been drawn out, the film moving unit 8 causes the surface of the film 14 to contact one end of the outer side of the squeegee table 5 and rotates the back roller 16 at a predetermined speed, for example, at a peripheral speed of about 1 cm/sec so as to form a bent portion 14*a* on the leading end side of the film 14 by making use of its rigidity (see FIG. 5B). By letting the film 14 constantly maintain the form of the bent portion 14*a*, the film moving unit 8 causes the base 18 to move toward the inner peripheral side at a speed equal to the peripheral speed of the back roller 16 (FIG. 5B). Since the film 14 has already been stripped of the charge then and is under constant tension because of the tension applying means 22, the form of the bent portion 14*a* is controlled by the elasticity of the film 14 itself without the production of useless electrostatic force and slackness with respect to the squeegee table 5.

Upon the formation of the bent portion 14*a* at the leading end of the film 14 as described, the film 14 is made to stick to the surface of the bonding agent P, whereby the film 14 is forced by its own elasticity to contact the surface of the bonding agent. Therefore, air is prevented from intruding into the interface as much as possible without variation in the layer pressure of the bonding agent.

Figure 7:
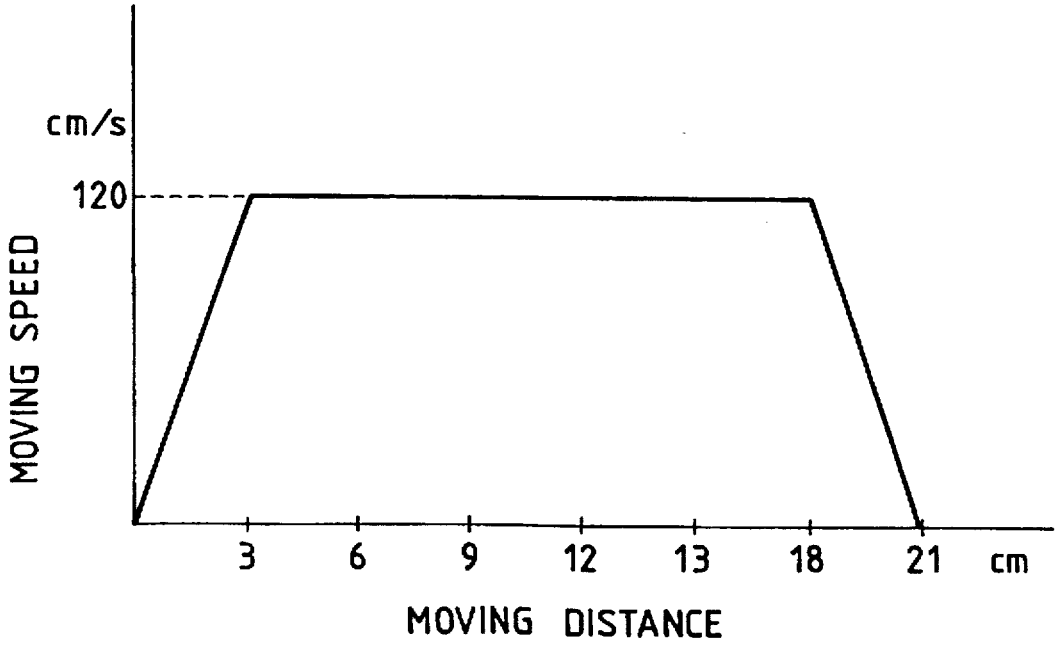
FIG. 7 is a chart showing the moving speed of the film when the film is peeled off the bonding agent.

When the film 14 has been pasted to the whole of the layer of the bonding agent P, the base 18 is slightly moved in the inner peripheral direction, for example, moved excessively by about 3 cm to provide an approach distance as shown in FIG. 7. Subsequently, the base 18 is moved immediately at a predetermined speed in the outer peripheral direction, that is, at a speed of V at which separation occurs in the middle of the bonding agent layer, namely, at about 120 cm/sec in such a state that the film 14 is suspended from being paid out by stopping the rotation of the back roller 16.

Figure 5C:
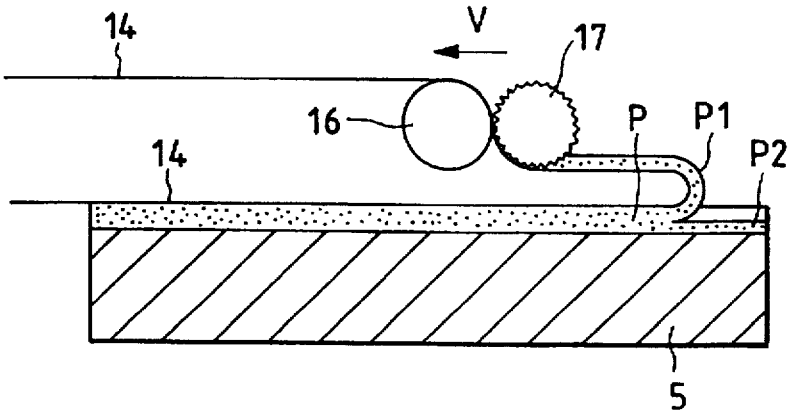

When the film 14 is thus moved fast, the bonding agent manifests elastic properties out of the viscoelastic properties, so that the whole thickness of the layer spread on the squeegee table 5 is divided into two, each having substantially half the thickness. In other words, the bonding agent p 2 in the lower half portion sticks onto a spreading side 11, whereas the bonding agent in the upper half portion P1 is peeled off in such a state that it becomes bonded onto the film 14 (FIG. 5C). Even in this peeling-off process, the film 14 produces no slackness as constant tension is applied thereto by the tension applying means 22.

Because the other squeegee table 4 is located under the squeegee unit 7 when the squeeze unit 5 is located below the film moving unit 8, work efficiency is improved by spreading the next bonding agent on the squeegee table 4 while the bonding agent is removed from the squeeze table 5.

Figure 6A:
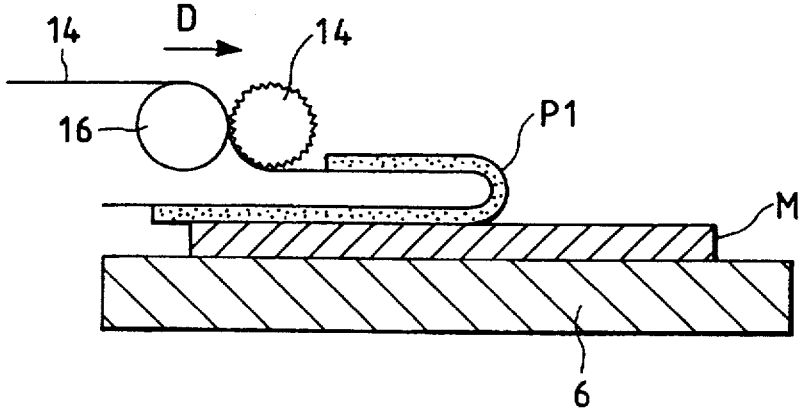
FIGS. 6A–6C are process diagrams each illustrating the steps of transferring the bonding agent to an adhered in the method of transferring the bonding agent according to the present invention.

The rotary table 1 is turned to move the adhered mounting table 6 to a position under the film moving unit 8 at the time the film 14 has completely been peeled off. The film 14 on which the bonding agent layer P1 has been spread uniformly to the required thickness is then appropriated so that the side of the bonding agent P1 is made to contact one end of a member M onto which the bonding agent should be applied and subsequently the base 18 is moved in the inner peripheral direction at a speed of about 1 cm/sec (FIG. 6A). Thus the elastic force of the film 14 as well as the weight of the film 14 and the bonding agent P1 causes the bonding agent P1 to contact the member M.

Figure 6B:
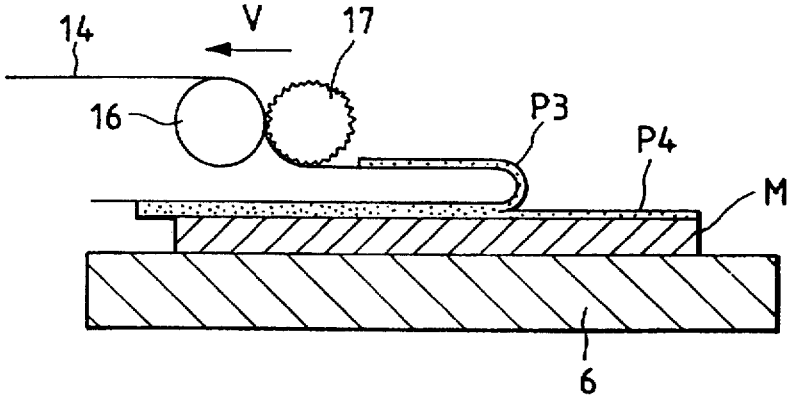
Figure 6C:
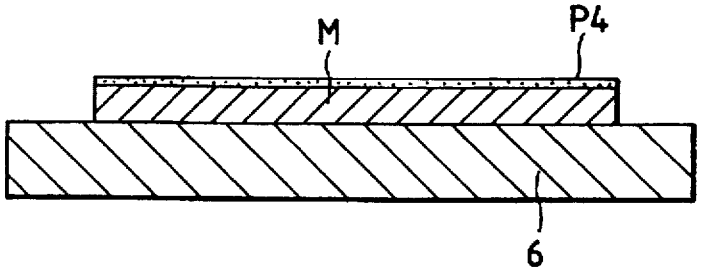

As in the case where the film 14 was peeled off the bonding agent of the squeegee table 5, the film 14 is peeled off the member M in such a state that the base 18 is moved constantly at a speed of 120 cm/sec in the approach section. Thus the lower half portion p 4 of the bonding agent layer p 1 sticks onto the member M as stated above, whereas the upper half portion of the bonding agent p 3 sticking to the film 14 is peeled off (FIG. 6B), whereby half the bonding agent layer P1 of the film 14, that is, a bonding agent having a thickness approximately equal to one quarter of the thickness of the bonding agent spread on the squeegee table 5 is transferred to the member M (FIG. 6C).

When the transfer of the bonding agent onto the member M is completed, the used area of the film 14 is wound on the winding roller 23 in preparation for the next transfer by making a new area face the squeegee table 4.

Although a description has been given of a case where the film 14 is peeled off once according to the above embodiment of the invention, the sticking and peeling operations may be performed twice by applying the same step as stated previously to the bonding agent of the squeegee table 4 in order to reduce further the thickness of bonding agent layer P1. The same effect can be accomplished by applying the film with the bonding agent spread thereon to a third flat plate and then peeling off the film fast likewise, so that the thickness of the bonding agent thus spread is halved further. Consequently, the bonding agent layer about ⅛ in thickness of the bonding agent initially spread on the squeegee table can be transferred to the member M when the bonding agent spread on the film is transferred to the member M as a target.

Although the rollers 16, 17 are stopped from rotating when the film 14 is peeled off the bonding agent according to the above embodiment of the invention, the film 14 can be wound up by rotating the rollers 16, 17 at a peripheral speed equal to the moving speed of the film 14 because the fixing rollers 17, 17 are absent on the bonding agent spreading side in a case where the peeling distance is long. Therefore, the film 14 becomes easy to handle.

The film is moved before being peeled off the bonding agent according to the above embodiment of the invention.

However, the same effect is obviously achievable by moving the squeegee tables 4, 5 by means of a driving means instead.

As set forth above, since there are provided the steps of firstly, spreading the bonding agent in the form of a layer having a predetermined thickness on the bonding-agent spreading side; secondly, paying out the film made of elastic material from one end to the other end of the bonding-agent spreading side at a predetermined speed and sticking the film onto the bonding agent layer; thirdly, peeling the film off the spreading side relatively at a speed at which the upper half of the bonding agent layer is peeled off from the other end of the spreading side; and fourthly, transferring the bonding agent layer spread on the film to the adhered according to the present invention, it is possible to form a thin bonding agent layer on the film by dividing the bonding agent layer into two to have the elastic properties of the bonding agent manifested. When the thin bonding agent layer is transferred to the adhered, the bonding agent layer that can be transferred to the adhered is ¼ in thickness in comparison with what is peeled and spread on the squeegee table.

What is claimed is:

1. An apparatus for transferring a bonding agent comprising:

a first squeegee table having a bonding-agent spreading side and a guideway on both sides of the bonding-agent spreading side, each said guideway having a predetermined height with respect to the bonding-agent spreading side;

a squeegee unit for moving a blade at a predetermined speed on each said guideway; and film moving means for feeding a predetermined amount of a film made of elastic material from a first end to a second end of the bonding-agent spreading side at a predetermined speed for removing the film, together with a portion of the bonding agent, from the second end of the bondin g-agent spreading side at a speed at which the bonding agent manifests elasticity.

2. An apparatus for transferring a bonding agent as claimed in claim 1, wherein the film moving means has a back roller and two retaining rollers which are gear-shaped in cross section and each contact a part of the back roller at both ends of the back roller.

3. An apparatus for transferring a bonding agent as claimed in claim 1, including static eliminator means for removing the charge of the film, the static eliminator means being installed on the upstream side of the film moving means, and tension applying means for giving the film a predetermined magnitude of tension on the downstream side thereof.

4. An apparatus for transferring a bonding agent as claimed in claim 1, further including a second squeegee unit, wherein said first and second squeegee units are symmetrically arranged on a rotary table.

5. An apparatus for transferring a bonding agent as claimed in claim 4, further including a mounting table, positioned on said rotary table circumferentially between said first and second squeegee units, for holding a member on which the bonding agent is deposited by said film moving means.

6. An apparatus for transferring a bonding agent as claimed in claim 1, further including a rotary table, and a mounting table, positioned on said rotary table together with said first squeegee, for holding a member on which a portion of the bonding agent adhered to the film is deposited by said film moving means;

wherein said portion of said bonding agent adhered to said film when said film moving means removes the film from the bonding-agent spreading side of side squeegee table is substantially one-half the bonding agent applied to the bonding-agent spreading side of said squeegee table; and wherein said portion of the bonding agent deposited by the film moving means on a member to be coated with the bonding agent, is substantially one-half the bonding agent adhered to the film.

* * * * *